US005259352A

United States Patent [19]

Gerhardy et al.

[11] Patent Number: 5,259,352

[45] Date of Patent: Nov. 9, 1993

[54] MEMBRANE FUEL PUMP FOR A MEMBRANE CARBURETOR

[75] Inventors: Reinhard Gerhardy, Korb; Werner Vonderau, Althütte, both of Fed. Rep. of Germany

[73] Assignee: Andreas Stihl, Waiblingen, Fed. Rep. of Germany

[21] Appl. No.: 13,970

[22] Filed: Feb. 5, 1993

[30] Foreign Application Priority Data

Feb. 6, 1992 [DE] Fed. Rep. of Germany ... 9201455[U]

[51] Int. Cl.[5] ..... F02B 33/04; F04B 43/02; F02M 17/04

[52] U.S. Cl. ..... 123/509; 123/73 C; 417/380; 417/395

[58] Field of Search ..... 123/509, 510, 73 AD, 123/73 AF, 73 C; 417/380, 383, 395

[56] References Cited

U.S. PATENT DOCUMENTS 4,430,048 2/1984 Fritsch ..... 417/383
4,473,340 9/1984 Walsworth ..... 417/380
4,813,391 3/1989 Geyer et al. ..... 417/395
4,928,390 5/1990 Gassen et al. ..... 123/73 AD
4,932,370 6/1990 Schierling et al. ..... 123/73 AD
4,976,246 12/1990 Schierling et al. ..... 123/509

*Primary Examiner*—E. Rollins Cross
*Assistant Examiner*—Thomas N. Moulis
*Attorney, Agent, or Firm*—Walter Ottesen

[57] ABSTRACT

The invention is directed to a membrane fuel pump for a membrane carburetor of an internal combustion engine. The carburetor has a pressure controller and the engine has a crankcase wherein pressure fluctuates during the operation thereof. The membrane fuel pump includes a pump membrane mounted in a housing which partitions a space of the housing into a pump chamber for receiving fuel from a fuel supply connection and a drive chamber. The drive chamber is charged with the pressure of the crankcase. A pressure connection connects the pump chamber to the pressure controller of the membrane carburetor. A bypass channel connects the pressure connection to the fuel supply connection and a valve is interposed between the pressure connection and the bypass channel. This valve is responsive to the pressure present in the pressure connection for switching the valve between a first position wherein the bypass channel is open to the pressure connection and a second position wherein the bypass channel is closed to the pressure connection.

13 Claims, 2 Drawing Sheets

MEMBRANE FUEL PUMP FOR A MEMBRANE CARBURETOR

FIELD OF THE INVENTION

The invention relates to a membrane fuel pump for a membrane carburetor for an internal combustion engine such as a two-stroke engine of a portable handheld work apparatus such as a motor-driven chain saw or the like.

BACKGROUND OF THE INVENTION

In a known membrane fuel pump of the kind referred to above, a major part of the fuel volume pumped in idle flows back via the bypass during the idle mode of a two-stroke engine because the pressure controller allows only a small quantity of fuel to pass into the control chamber. The average pressure measured during idle on the pressure end of the pump is less by a factor of 10 than for a pump without a bypass so that the pressure controller operates without disturbance in accordance with its characteristic and main nozzle drip is substantially avoided.

A significant fuel quantity flows to the pressure controller during full load and only a small quantity of fuel flows off via the throttle of the bypass. In this way, a pumping volume of the pump adapted approximately to the engine speed is obtained at an average pressure to be controlled by the pressure controller. However, it is precisely in the full-load case that the reduction of the pumping capacity is disadvantageous which is caused by the bypass so that the pump must, in most cases, be configured larger to compensate for this reduction.

In addition, operating conditions can occur in the case of idle wherein the pressure drop caused by the bypass, which is in principle wanted, is disturbing. If a higher suction capacity of the pump is required, for example, because of a blocked tank vent, then the drop in pressure provided at the pressure end is disadvantageous. Because of the bypass, such a pressure drop can occur even forward of the pressure controller so that the idle mixture becomes lean and the engine stalls. If the above-described condition occurs during part load, the leaning of the fuel mixture not only causes a disturbing drop in power but a longer duration of operation with a lean mixture can lead to serious engine damage such as seizing of the piston or the like.

SUMMARY OF THE INVENTION

It is an object of the invention to improve a membrane fuel pump of the kind described above in such a manner that a leaning of the mixture because of a reduced pump capacity is reliably avoided while maintaining the desired pressure drop produced by the bypass during idle.

The invention is directed to a membrane fuel pump for a membrane carburetor of an internal combustion engine including a two-stroke engine of a portable handheld work apparatus such as a motor-driven chain saw and the like. The carburetor has a pressure controller and the engine has a crankcase wherein pressure fluctuates during operation of the engine. The membrane fuel pump includes: a housing defining an enclosed space; a pump membrane mounted in the housing and partitioning the space into a pump chamber and a drive chamber; a line connecting the crankcase to the drive chamber for charging the drive chamber with the pressure in the crankcase; fuel supply means for supplying fuel to the pump chamber; a first check valve interposed between the pump chamber and the fuel supply means; pressure connection means for connecting the pump chamber to the pressure controller of the membrane carburetor; a second check valve interposed between the pressure connection means and the pump chamber so as to permit fuel to flow from the pump chamber through the pressure connection means to the pressure controller of the carburetor when the second check valve is open and to interrupt the flow of fuel when the second check valve is closed; the housing including a bypass channel connecting the pressure connection means to the fuel supply means; and, valve means interposed between the pressure connection means and the bypass channel and being responsive to the pressure present in the pressure connection means for switching the valve means between a first position wherein the bypass channel is open to the pressure connection means and a second position wherein the bypass channel is closed to the pressure connection means.

The bypass can be blocked by a valve having a valve member controlled by the pressure present in the pressure connection. For this reason, a closing of the bypass is ensured when too great a pressure drop is present in the pressure connection thereby reliably avoiding making the mixture lean. On the other hand, it is also ensured that a pressure, which is too high, will be reduced through the bypass especially during idle since a pressure, which is too high, leads to a displacement of the valve member in the sense of an opening of the blocking valve.

The valve member is advantageously configured as a membrane which delimits a control chamber through which a flow passes from the pressure connection to the pressure controller. This valve member also covers the bypass in its at-rest position. The bypass starts at and extends from the control chamber. The membrane is continuously subjected to the pressure present at the pressure connection because the membrane delimits the control chamber. For this reason, the membrane can react to pressure differences by corresponding deflections. The bypass is covered by the edge region of the membrane and is therefore always opened when the membrane is so far deflected because of a high pressure that the edge region lifts off the covered bypass and opens the latter. If in contrast, the pressure drop is extreme, then the membrane returns to its at-rest position and closes the bypass so that the complete pump capacity is available. A spring is mounted on the side of this membrane facing away from the control chamber to ensure a reliable closure. The spring is preferably a helical spring and applies a force to the membrane in the direction toward its at-rest position.

According to another feature of the invention, the membrane is charged on its side facing away from the control chamber with intake-pipe pressure branched off downstream of the throttle flap in order to ensure a clean opening of the check valve during idle. The underpressure always operates in the sense of a displacement of the membrane in the direction of pressure chamber when the throttle flap is closed and the underpressure downstream of the throttle flap takes on significant values. In this way, the edge region of the membrane lifts away from the bypass and the pump is short circuited.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
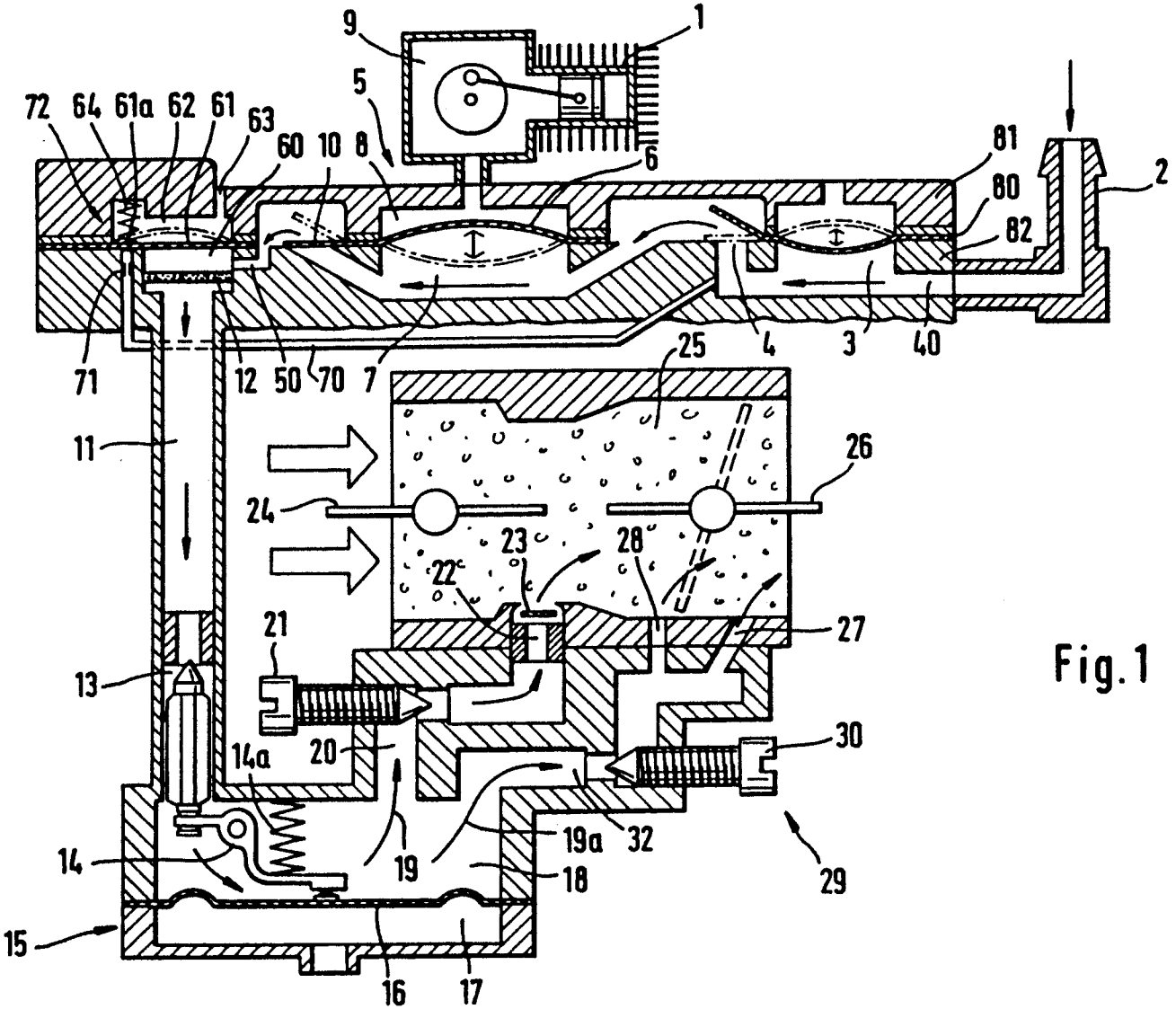
FIG. 1 is a schematic of a membrane fuel pump according to the invention having a blocking valve and shown with a membrane carburetor connected thereto; and, FIG. 2 is a schematic of a membrane fuel pump of the kind shown in FIG. 1 equipped with a blocking valve charged with pressure from the intake pipe.

The membrane carburetor 29 shown in the drawings is provided especially for a two-stroke internal combustion engine mounted in portable handheld work apparatus such as chain saws, cutoff machines, brushcutters or the like. The carburetor is supplied via a pressure controller 15 from a membrane fuel pump 5 which draws fuel by suction from a fuel tank (not shown) and pumps the fuel to the pressure controller 15. The fuel first flows via the feed line 2 of the fuel tank into a compensating chamber 3 and from there via a check valve 4 into a pump chamber 7 of the fuel pump 5. The check valve 4 is configured as a flap valve. The pump chamber 7 is partitioned from a drive chamber 8 of the fuel pump 5 by a membrane 6. The drive chamber 8 communicates with the crankcase 9 of an internal combustion engine 1 such as a two-stroke engine and is charged by the changing crankcase internal pressure in this manner.

If underpressure is present in the drive chamber 8, the membrane 6 deflects arcuately as shown thereby reducing the volume of the drive chamber 8 and increasing the volume of the pump chamber 7. Fuel is now drawn into the pump chamber 7 via the suction connection 40 and the now open flap valve 4.

If the internal pressure in the crankcase changes to positive values, the membrane 6 deflects in the sense of reducing the volume of the pump chamber 7 and the fuel in the pump chamber 7 is subjected to pressure. The check valve 4 closes and a check valve 10 opens. The check valve 10 is arranged on the pressure end of the pump 5 and is likewise configured as a flap valve. The fuel flows via a pressure connection 50 into a control chamber 60 and flows from there to the pressure controller 15 via a fine filter 12 and a pressure line 11.

The pressure controller 15 of the membrane carburetor 29 comprises essentially a control chamber 18 which is partitioned by a control membrane 16 from a chamber 17 at atmospheric pressure. One end of a controller lever 14 is applied to the center of the control membrane 16 and the other end of this lever controls a feed valve 13. The feed valve 13 is configured as a needle valve. It can also be advantageous to configure the feed valve as a flat valve. The controller lever 14 is biased by a spring **14*a* in the direction of closure of the feed valve 13 so that the inlet to the control chamber 18** is at first closed.

A main nozzle channel 20 leads from the control chamber 18 via a main nozzle 22 into the intake pipe 25 of the internal combustion engine 1. The flow cross section of the main nozzle channel 20 is adjustable by means of a control screw 21. The main nozzle 22 is closed by a check valve 23 which opens into the intake pipe 25. The main nozzle 22 opens into the intake pipe 25 in a region between a starter flap 24 and a throttle flap 26.

From the control chamber 18, an idle nozzle channel 32 leads to an idle nozzle 27 which opens into the intake pipe 25 downstream of the throttle flap 26 when the throttle flap is in the idle position (shown in phantom outline in FIG. 1). The opening cross section of the idle nozzle channel 32 is adjustable by a control screw 30. A bypass channel 28 branches off from the idle nozzle channel 32 downstream of the control screw 30. The bypass channel 28 opens into the intake pipe 25 forward of the throttle flap 26 (in its idle position shown in phantom outline in FIG. 1) when viewed in the flow direction of the intake air.

The intake pipe 25 is shown fully open in the full-load position shown in FIG. 1 so that the fuel is drawn in by suction via the main nozzle channel 20 (arrow 19) as well as via the idle nozzle channel 32 (arrow **19*a*) into the venturi section of the intake pipe 25. The underpressure in the control chamber 18 developed thereby leads to a displacement of the control membrane 16 whereby the controller lever 14 is actuated so that the feed valve 13 is opened and the fuel pumped by the membrane fuel pump 5** flows in.

In the idle position of the throttle flap 26 shown in phantom outline in FIG. 1, fuel flows into the intake pipe 25 downstream of the throttle flap 26 exclusively via the idle nozzle 27. The pressure connection 50 of the fuel pump 5 is connected to its intake connection 40 via a bypass 70 in order to ensure a reliable closure of the check valve 23 of the main nozzle 22 during the idle position. A throttle 71 is mounted in the bypass 70. The bypass 70 branches off from a control chamber 60 into which the pressure connection 50 opens and from which the pressure line 11 leads to the pressure controller 15. The control chamber 60 is delimited by a membrane 61 and a pressure chamber 62 is formed on the side of the membrane facing away from the control chamber 60. The pressure chamber 62 is advantageously vented to the atmosphere via an opening 63. The membrane 61 is disposed transversely to the bypass 70 and covers the bypass in its at-rest position shown in FIG. 1. The membrane 61 then defines a valve member which, together with the opening of the bypass 70 defines a valve 72 by means of which the bypass can be blocked. The opening of the bypass 70 communicates with the control chamber 60 when the valve 72 is open.

As shown in FIG. 1, the membrane 61 is biased with a force via a spring 64 on the side of the membrane facing away from the control chamber 60. The spring 64 is preferably a helical spring. The membrane 61 covers the bypass 70 with its edge region **61*a* with the spring 64 being disposed opposite the bypass 70**.

According to a feature of the invention, a common foil 80 defines the following: membrane 61 delimiting the control chamber 60, the membrane 6 of the fuel pump 5 and the flaps of the check valves 4 and 10. The foil 80 is held between two housing parts 81 and 82 of the fuel pump 5.

In idle, only a small amount of fuel flows into the control chamber 18 via the needle valve 13 so that an increased pressure builds up in the pressure line 11 and the control chamber 60. In this way, the membrane 61 of the control chamber 60 is deflected and lifts away from the bypass 70 after overcoming the spring force of the helical spring 64 as shown in phantom outline whereby, in idle, a part of the pumped volume flows back to the intake connection 40. In this way, the pump capacity of the pump 5 is reduced and the pressure in the control chamber 60 and the pressure line 11 is reduced to a mean pressure against which the needle valve 13 can provide a reliable closure.

During full load, a considerable fuel flow develops in the pressure controller 15 whereby a pressure increase above a limit value does not occur so that the membrane 61 is essentially not deflected and the bypass 70 remains covered by the corresponding portion 61*a* of the membrane 61 under the action of the helical spring 64. The undiminished pumping capacity of the fuel pump 5 is available during full load.

If the fuel pump is required to develop an increased suction power during operation of the engine, for example, when the vent of the fuel tank is blocked, then the pressure at the pressure end of the pump 5 in the control chamber 60 first drops and the membrane 61 effects a closure of the bypass 70. As soon as the bypass is closed, the complete pumping capacity of the pump 5 is available to pump the required fuel quantity to the pressure controller 15 against the increased suction pressure, this fuel quantity being required for a trouble-free operation of the engine.

Figure 2:
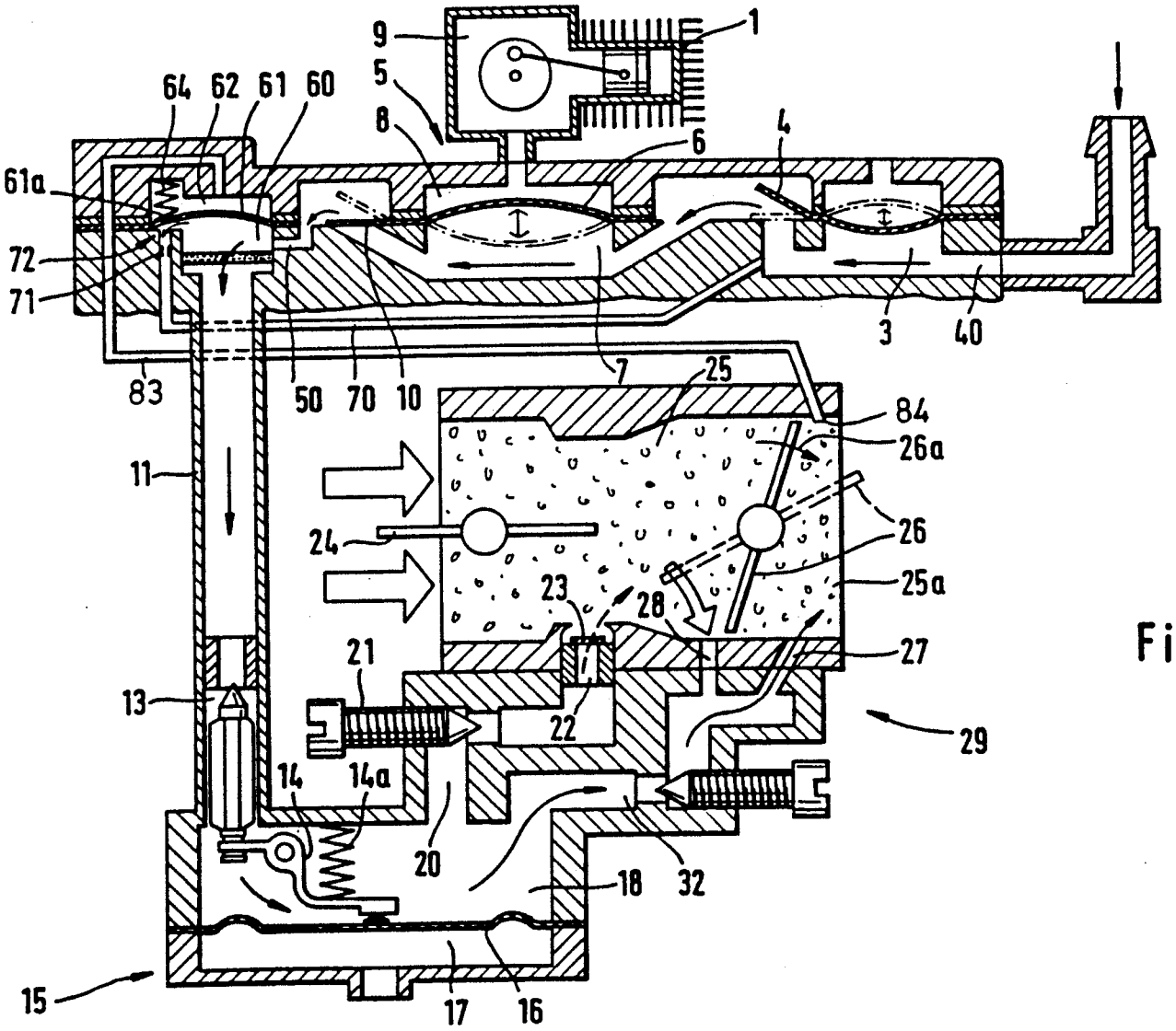

According to the embodiment of the invention shown in FIG. 2, the pressure chamber 62 is closed off against the atmosphere and is connected via a pressure channel 83 to the intake pipe 25. The pressure channel 83 taps from the intake channel 25 downstream of the throttle flap shown in the idle position and preferably near the throttle flap. Underpressure develops downstream of the throttle flap in the intake pipe section 25*a* when the throttle flap is closed (solid outline), that is, during idle. The connection of the pressure channel 83 then causes this underpressure to also be present in the pressure chamber 62 and causes the membrane 61 to arcuately deflect into the pressure chamber 62 so that the bypass 70 is opened. In idle, a drop of the quantity pumped by the pump 5 as well as a pressure drop in the pressure line 11 to the pressure controller 15 is achieved.

Starting at a predetermined part-load position, the throttle flap 26 pivots in the direction of arrow 26*a* into the position shown in phantom outline and passes the opening 84 of the pressure channel 83 whereby the pressure chamber 62 is charged with the pressure present in the intake pipe upstream of the throttle flap. This pressure is higher than the underpressure which was previously present. The membrane 61 returns toward its at-rest position and the helical spring 64 effects a closure of the bypass 70 and the fuel pump operates at full pumping capacity. In this way, a switching of the valve 72 is effected in correspondence to the position of the throttle flap 26. A closure of the bypass 70 can be produced by an actuation of the throttle flap 26 or the throttle lever (with a corresponding selection of the membrane stiffness and/or the helical spring 64 independently of the pressure present in the control chamber 60), that is, a switchover of the pump 5 to full pumping capacity can take place.

It is understood that the foregoing description is that of the preferred embodiments of the invention and that various changes and modifications may be made thereto without departing from the spirit and scope of the invention as defined in the appended claims.

What is claimed is:

1. A membrane fuel pump for a membrane carburetor of an internal combustion engine including a two-stroke engine of a portable handheld work apparatus such as a motor-driven chain saw and the like, the carburetor having a pressure controller and the engine having a crankcase wherein pressure fluctuates during operation of the engine, the membrane fuel pump comprising:

a housing defining an enclosed space;

a pump membrane mounted in said housing and partitioning said space into a pump chamber and a drive chamber;

a line connecting said crankcase to said drive chamber for charging said drive chamber with the pressure in said crankcase;

fuel supply means for supplying fuel to said pump chamber;

a first check valve interposed between said pump chamber and said fuel supply means;

pressure connection means for connecting said pump chamber to the pressure controller of the membrane carburetor;

a second check valve interposed between said pressure connection means and said pump chamber so as to permit fuel to flow from said pump chamber through said pressure connection means to said pressure controller of said carburetor when said second check valve is open and to interrupt the flow of fuel when said second check valve is closed;

said housing including a bypass channel connecting said pressure connection means to said fuel supply means; and, valve means interposed between said pressure connection means and said bypass channel and being responsive to the pressure present in said pressure connection means for switching said valve means between a first position wherein said bypass channel is open to said pressure connection means and a second position wherein said bypass channel is closed to said pressure connection means.

2. The membrane fuel pump of claim 1, further comprising biasing means for biasing said valve means in said second position.

3. The membrane fuel pump of claim 1, said enclosed space being a first enclosed space; said pressure connection means including a second enclosed space in said housing; said valve means including a control membrane partitioning said second enclosed space to define a control chamber communicating with both said pump chamber via said second check valve and said pressure controller of said carburetor; said bypass channel having a bypass opening communicating with said control chamber; and, said membrane being deflectable between said first position and said second position and being arranged in said housing so as to also cover said bypass opening when in said second position.

4. The membrane fuel pump of claim 3, said membrane extending transversely to said bypass channel at said bypass opening.

5. The membrane fuel pump of claim 4, said bypass opening being formed in said housing next to said control chamber and said control membrane having an edge region extending beyond said control chamber to cover said bypass opening when said control membrane is in said second position.

6. The membrane fuel pump of claim 5, said control membrane being arranged in said second enclosed space to partition said second enclosed space into a pressure chamber as well as into said control chamber; said membrane fuel pump further comprising resilient biasing means mounted in said pressure chamber to resiliently bias said edge region of said control membrane in the direction of said second position thereof.

7. The membrane fuel pump of claim 6, said resilient biasing means being a spring mounted in said pressure chamber opposite said bypass opening.

8. The membrane fuel pump of claim 7, said spring being a helical spring.

9. The membrane fuel pump of claim 6, said control membrane having a first side facing into said pressure chamber and a second side facing into said control chamber; and, said pressure chamber having an opening communicating with the ambient thereby charging said control membrane with atmospheric pressure at said first side thereof.

10. The membrane fuel pump of claim 3, said carburetor including an intake channel for conducting an air/fuel mixture to the engine in a predetermined flow direction through said intake channel and a throttle flap pivotally mounted therein for pivoting between an idle position and a full-load position; said control membrane being arranged in said second enclosed space to partition said second enclosed space into a pressure chamber as well as into said control chamber; said control membrane having a first side facing into said pressure chamber and a second side facing into said control chamber; and, said membrane fuel pump further comprising connecting means for connecting said pressure chamber to said intake chamber downstream of said throttle flap viewed in said flow direction thereby charging said control membrane at said first side thereof with the pressure in said intake channel.

11. The membrane fuel pump of claim 10, said connecting means being a pressure channel connecting said intake channel to said pressure chamber.

12. The membrane fuel pump of claim 11, said pressure channel having an opening into said intake channel directly downstream of said throttle flap when said throttle flap is in said idle position; and, said opening of said pressure channel being positioned relative to said throttle flap so that said throttle flap passes thereover when said throttle flap moves into said full-load position.

13. The membrane fuel pump of claim 3, said first check valve, said pump membrane, said second check valve and said control membrane being conjointly defined by a common foil.

* * * * *